US006960736B1

(12) United States Patent
Bach et al.

(10) Patent No.: US 6,960,736 B1
(45) Date of Patent: Nov. 1, 2005

(54) SWITCHING GAS DAMPER FOR LOW-VOLTAGE POWER CIRCUIT BREAKERS

(75) Inventors: Michael Bach, Berlin (DE); Detlev Schmidt, Berlin (DE); Michael Sebekow, Berlin (DE); Guenter Seidler-Stahl, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/018,329

(22) PCT Filed: Apr. 20, 2000

(86) PCT No.: PCT/DE00/01304

§ 371 (c)(1),
(2), (4) Date: Apr. 29, 2002

(87) PCT Pub. No.: WO00/65621

PCT Pub. Date: Nov. 2, 2000

(30) Foreign Application Priority Data

Apr. 23, 1999 (DE) ..... 199 20 042

(51) Int. Cl.[7] ..... H01H 33/02

(52) U.S. Cl. ..... 218/155; 218/157; 200/306; 335/201

(58) Field of Search ..... 218/155–158, 218/147–151, 34–38; 335/201, 202, 6; 200/306

(56) References Cited

U.S. PATENT DOCUMENTS 2,310,728 A * 2/1943 Bartlett ..... 218/35
3,582,966 A * 6/1971 Strobel ..... 218/149
3,621,169 A * 11/1971 Heft et al. ..... 218/152
5,731,561 A 3/1998 Manthe et al.
5,756,951 A 5/1998 Manthe et al.
6,222,146 B1 * 4/2001 Turkmen ..... 218/149
6,670,872 B2 * 12/2003 Kurzmann ..... 335/201

FOREIGN PATENT DOCUMENTS

| | | |
|---|---|---|
| CH | 1 104 019 | 10/1959 |
| DE | 85 31 352 1 | 2/1986 |
| DE | 35 41 514 C2 | 5/1987 |
| DE | 43 33 278 A1 | 3/1995 |
| DE | 44 10 108 A1 | 9/1995 |
| EP | 437 151 B1 | 7/1991 |
| EP | 437 151 A1 | 7/1991 |
| FR | 2 511 188 | 2/1983 |

OTHER PUBLICATIONS

English Translation of DE 44 10 108 A1.

* cited by examiner

*Primary Examiner*—Karl D. Easthom
*Assistant Examiner*—M. Fishman
(74) *Attorney, Agent, or Firm*—Harness, Dickey & Pierce, P.L.C.

(57) ABSTRACT

A switching gas damper for low-voltage power circuit breakers, is arranged as an attachment above the arcing chambers for additional damping, deionization and cooling of the switching gases. The switching gas damper includes a cuboid enclosure with separate inlet openings to receive switching gas flows from each arcing chamber in the low-voltage power circuit breaker. Separate outlet channels are formed by channel walls and/or by deflection elements and are routed on both sides of the power circuit breaker. A variable arrangement of the deflection elements and outlet channels makes it possible to produce a number of mutually separate flow paths, with different desired damping and cooling characteristics, as a function of the gas amounts that occur and of the characteristics of the arcing chambers that are used.

21 Claims, 5 Drawing Sheets

SWITCHING GAS DAMPER FOR LOW-VOLTAGE POWER CIRCUIT BREAKERS

This application is the national phase under 35 U.S.C. § 371 of PCT International Application No. PCT/DE00/01304 which has an International filing date of Apr. 23, 2000, which designated the United States of America, the entire contents of which are hereby incorporated by reference.

FIELD OF THE INVENTION

The invention generally relates to a switching gas damper for a multipole low-voltage power circuit breaker. More preferably, it relates to one which is arranged as an attachment above the parallel arcing chambers for additional damping, deionization and cooling of the switching gases, with the attachment having a cuboid enclosure with a front wall, a rear wall and a cover.

BACKGROUND OF THE INVENTION

Such a switching gas damper, as has been disclosed by EP 0 437 151 B1, has the object of assisting the effect of an arc quenching device for low-voltage power circuit breakers which switch in air. The arc quenching device causes switching arcs which occur during operation of the power circuit breaker to be quenched without adversely affecting the power circuit breaker itself, adjacent system parts, or other assemblies. These arc quenching devices or arcing chambers have very different physical forms, depending on the type, the physical size and the switching rating demanded of the power circuit breaker. These devices all have the common feature of a more or less parallel arrangement of arcing plates composed of sheet steel and arranged transversely with respect to the switching arc.

In order to reliably quench switching arcs, the switching gases produced do not have to be cooled down to room temperature. At least when the rating of an arc quenching chamber is fully utilized, it is thus possible for gases to emerge from the arcing chamber at a temperature that is considerably greater than room temperature. Metal vapor residues can thus also be carried with the gases, and there may be a certain amount of ionization. The installation type of power circuit breaker governs whether such phenomena are harmless. Fundamentally, it can be stated that an amount of metal vapor and residual ionization become less acceptable the shorter the distance between the outlet openings from the arc quenching chambers and adjacent live or grounded components. This distance is an important cost factor in the construction of switchgear assemblies, since the dimensions of the switchgear assemblies depend on it.

On the other hand, the cost rises when arc quenching chambers are designed such that they satisfy the most stringent requirements with regard to the characteristics of the switching gases that occur. For this reason, the approach has therefore been adopted of equipping low-voltage power circuit breakers with standard arcing chambers which result in a given switching rating, but which represent a compromise between the minimum and maximum requirements with regard to the characteristics of the switching gases that occur. For situations in which a power circuit breaker must be accommodated in a particularly space-saving manner in a switchgear assembly, additional switching gas dampers are provided, according to the cited EP 0 437 151 B1, and are common to all the arcing chambers.

The known switching gas damper forms a shroud, which covers all the arcing chambers in the power circuit breaker.

Before the switching gases can escape from the shroud, they flow through a cooling grid and an outlet filter. The upward flow direction of the switching gases is not influenced by this. This may be undesirable, if there is only a small amount of space above the power circuit breaker. Furthermore, the process of collecting the switching gases from all the arcing chambers in a common space requires an adequate volume in order to avoid an electrical phase flashover in all circumstances.

SUMMARY OF THE INVENTION

Against this background, an object of the present invention is to provide a switching gas damper for low-voltage power circuit breakers for additional damping, deionization and cooling of the switching gases, which allows the switching gases to be deflected into a direction other than the natural vertical direction, and whose efficiency is considerably improved.

The invention achieves such an object, for example, in that the cover is closed and a bottom having separate inlet openings is provided for receiving switching gas flows from each arcing chamber in the low-voltage power circuit breaker, and in that each inlet opening has an associated outlet channel, which is formed by channel walls and/or deflection elements, in order to dissipate the switching gas flows at the sides.

One feature of the invention is the provision of separate outlet channels for the switching gas flows from the individual arcing chambers in a common enclosure, since this advantageously allows the total volume to be made small. Carrying the switching gas flows away at the sides avoids any contact with the power circuit breaker connecting rails at the rear.

FR 2 511 188 A1 has, for example, already disclosed a switching gas damper which ensures that the flow direction of switching gases is deflected. The switching gas damper may be in the form of a shroud, whose open lower face is placed onto an arc quenching chamber and is sealed from it by grooves or separate scaling device. The switching gas damper may also be integrated in the enclosure of the arc quenching chamber in such a way that walls which are used to guide the switching gas flows are part of the enclosure of the arcing chamber, but they do not carry out their function until a cover is fitted. All the embodiments of this switching gas damper have the common feature of a single-pole configuration for double-interrupting contact systems (bridge contacts). In this case, the switching gases of both switching contacts of one pole are deflected to opposite sides in the direction of the mutually opposite connecting rails. This does not represent any improvement for power circuit breakers which have a front control panel and connections at the rear, and does not achieve the object.

A further known switching gas damper according to DE 1 104 019 B, for example, likewise has one pole. This is suitable for power circuit breakers with one switching contact per pole, and deflects the switching gases to the sides of each arc quenching chamber, after splitting them into two flow elements. The use of this switching gas damper in a multipole power circuit breaker would thus require the entire switching device to be broadened, without ensuring that the switching gases can flow away freely. This switching gas damper therefore does not allow said object to be achieved economically, either.

For the purposes of the invention, an arrangement is recommended for three-pole low-voltage power circuit breakers in which a channel wall is arranged el to the front wall and a further channel wall is arranged parallel to the rear wall. Thus, in conjunction with deflection elements, a total of three outlet channels are formed of which the outer outlet channels, which are bounded by the front wall and by the rear wall, are closed on opposite sides by a side wall. Further, the central outlet channel, which is bounded by the channel walls, is open on both sides. As such, the switching gas flows which emerge from the outer arcing chambers of the low-voltage power circuit breaker are carried away separately on opposite sides. In addition, the switching gas flow which emerges from the central arcing chamber passes from the switching gas damper to free space on both sides through the central outlet channel. Despite the switching gas damper having small dimensions this advantageously results in long flow paths, with a correspondingly advantageous cooling effect on the switching gases.

The deflection elements and channel walls can be arranged and shaped in various ways. In particular, the channel walls may extend from the bottom to the cover of the switching gas damper and the side walls may be arranged on the same side of the switching gas damper as the outer arcing chambers. As such, the switching gas flows of the outer arcing chambers are passed, parallel to the front wall and to the rear wall of the switching gas damper, to the respectively opposite side of the low-voltage power circuit breaker. Further, the switching gas flow of the central arcing chamber is passed to the two opposite sides. This arrangement can be produced with planar wall elements of simple shape.

In particular, the first deflection element extends, starting from the bottom on the first channel wall, as far as the cover, and ending on the opposite channel wall. The further deflection element is arranged such that it rises in the opposite direction between the channel walls, with the side parts furthermore having a shape which is matched to the rising arrangement of the deflection elements, so as to separate the switching gas flows of the outer arcing chambers and of the central arcing chamber. Instead of this angled arrangement, the deflection elements are arranged parallel to the cover and to the bottom above the inlet openings for guiding the switching gas flows of the outer arcing chambers, and can extend from one channel wall to the other channel wall. In addition, side parts are arranged on the mutually facing sides of the deflection elements in order to separate the switching gas flows of the outer arcing chambers and the switching gas flow of the central arcing chamber.

Apart from this, in the case of the arrangement described above with the position parallel to the bottom and to the cover, the deflection elements can be arranged at any desired height position between the cover and the bottom of the switching gas damper. In particular, it has been found to be suitable to position the deflection elements at a height of ⅔ of the height of the switching gas damper away from the bottom.

Separate channel walls and deflection elements are provided in each case in the refinements of the invention described above. However, it may be advantageous for the deflection elements to be at the same time in the form of channel walls, and to be arranged such that the switching gas flows which emerge from the arcing chambers of the outer poles of the low-voltage power circuit breaker are carried away from the switching gas damper directly at the sides, that is to say each on the same side of the low-voltage power circuit breaker. Further, the switching gas flow which emerges from the central arcing chamber is carried via or alongside the deflection elements to both opposite sides of the switching gas damper.

The shortening of the flow paths in this case contrasts with simplified construction of the switching gas damper in a range of versions. In a first embodiment of this idea, the deflection elements can be arranged such that they extend from the bottom to the cover of the switching gas damper. In this case, the deflection elements are preferably arranged such that, originating from the front wall of the switching gas damper, they run between the inlet openings, which are located above the arcing chambers, in the direction of the rear wall, are then angled, and each run behind the inlet openings for the switching gases from the outer arcing chambers as far as the side boundary of the switching gas damper. They run in such a manner that an outlet channel is formed, which is coupled to the space above the central arcing chamber of the low-voltage power circuit breaker and is open on both sides of the switching gas damper, for the switching gas flow of this central arcing chamber. If a low flow resistance is desired, then the angles of the deflection elements may be rounded.

In addition, deflection elements can be provided which extend between the front wall and the rear wall of the switching gas damper and at the same time act as channel walls. This may be achieved in such a way that the deflection elements are arranged such that they extend between the front wall and the rear wall such that one outlet channel for an outer arcing chamber is in each case bounded by the bottom and a deflection element and an outlet channel, which is open on both sides and is connected to the central inlet opening in the bottom, is formed for the central arcing chamber between the deflection elements and the cover.

For the purposes of one aspect of the invention, the deflection of the switching gas flows, which are carried at the sides, parallel to the side walls of the low-voltage power circuit breaker can be carried out by way of a direction-changing enclosure with a guide chamber. This direction-changing enclosure may be angled.

The deflection of the switching gas flows can also be produced by the cover of the switching gas damper being designed to be broader than the low-voltage power circuit breaker and by providing side boundaries of the switching gas damper with guide elements pointing downward. Such guide elements can be formed in a simple manner by lengthening the side walls of the switching gas damper such that they extend downward.

BRIEF DESCRIPTION OF THE DRAWINGS

The invention will be explained in more detail in the following text using preferred exemplary embodiments, which do not restrict the scope of protection, and with reference to the associated drawing.

DETAILED DESCRIPTION OF THE PREFERRED EMBODIMENTS

Figure 1:
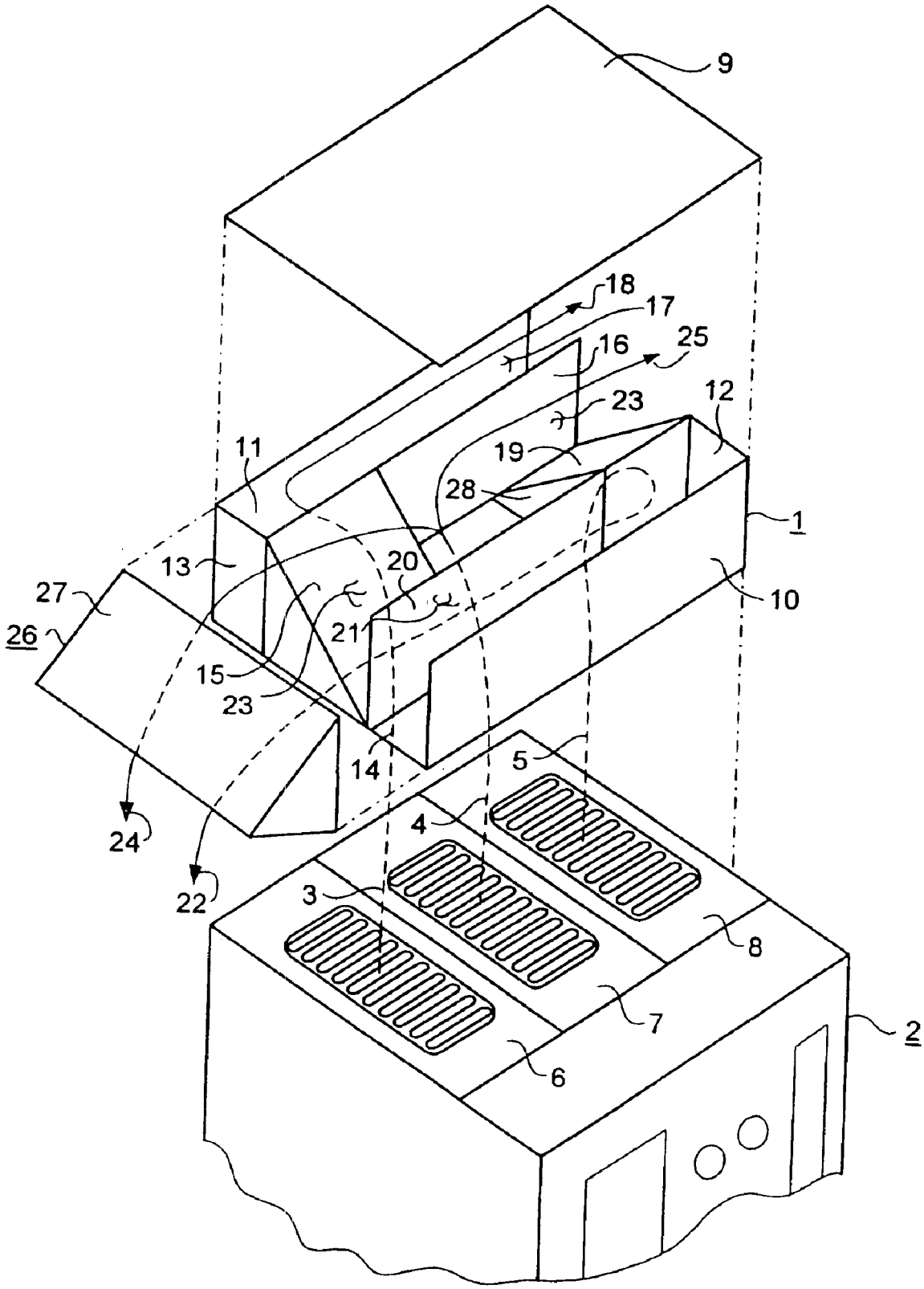
FIG. 1 shows a perspective schematic illustration of a first possible embodiment of the switching gas damper according to the invention in its physical position with respect to the low-voltage power circuit breaker, and the flow of the switching gases from the arcing chambers in this power circuit breaker, through the switching gas damper.

The switching gas damper 1 according to FIG. 1 is illustrated schematically in perspective in conjunction with a low-voltage power circuit breaker 2, only part of which is shown. The switching gas damper 1 is shown in a position raised above the power circuit breaker 2, in order to illustrate the interaction with the arcing chambers 6, 7 and 8, and the profile of the switching gas flows.

To provide a further illustration, the closed cover 9 of the switching gas damper 1 is illustrated in a raised position, with this switching gas damper 1 also having a front wall 10, a rear wall 11, a right-hand side wall 12, a left-hand side wall 13 and a bottom 14, which is closed away from the inlet openings.

A deflection element 15 with a side part 28 forms an outlet channel 17, which is open on the right-hand side of the switching gas damper 1, together with the left-hand side wall 13 and a channel wall 16 which extends from the bottom 14 of the switching gas damper 1 to its cover 9. A further deflection element 19 with a side part which cannot be seen forms an outlet channel 21, which is open on the left-hand side of the switching gas damper 1, together with the right-hand side wall 12 and a channel wall 20 which extends from the bottom 14 of the switching gas damper 1 to its cover 9. The two outlet channels 17 and 21 are closed at the top by the cover 9 of the switching gas damper 1, and at the bottom by its bottom 14. The one inclined arrangement, which rises from the bottom 14 to the cover 9, of the deflection elements 15 and 19 results in free spaces, which form a central outlet channel 23, remaining between the deflection elements 15 and 19 and the channel walls 16 and 20, respectively.

The switching gas flow 3 which emerges from the left-hand arcing chamber 6 of the low-voltage power circuit breaker 2 enters the switching gas damper 1 through the left-hand inlet opening, which is not illustrated for the sake of clarity and brevity. It is passed by the deflection element 15 into the outlet channel 17, which is formed by the cover 9, the left-hand side wall 13, the rear wall 11, the channel wall 16 and the bottom 14, from which it can emerge only on the right-hand side of the switching gas damper 1, as is indicated by an arrow 18.

The switching gas flow 5, which emerges from the right-hand arcing chamber 8 of the low-voltage power circuit breaker 2, enters the switching gas damper 1 through the right-hand inlet opening, which is likewise not shown, for the sake of clarity and brevity. It is passed through the deflection element 19 into the outlet channel 21, which is formed by the cover 9, the right-hand side wall 12, the front wall 10, the channel wall 20 and the bottom 14, from which it can emerge only on the left-hand side of the switching gas damper 1, as indicated by an arrow 22.

The switching gas flow 4, which emerges from the central arcing chamber 7 of the low-voltage power circuit breaker 2, enters the switching gas damper 1 through the central inlet opening, which is once again not illustrated in this case, for the sake of clarity and brevity. It passes directly into the outlet channel 23, which is formed by the cover 9, the channel wall 16, the channel wall 20, the deflection elements 15 and 19 and the bottom 14, from which it can emerge on both sides of the switching gas damper 1, as is indicated by the arrows 24 and 25.

In order to deflect the switching gas flow 3, which emerges on the left-hand side of the switching gas damper 1, and that part of the switching gas flow 4 (arrow 24), which emerges on the left-hand side from the switching gas damper 1, downward, a guide chamber 27 is provided. The guide chamber 27 is formed from an angled direction-changing enclosure 26 and is attached to the switching gas damper 1 at the side.

The guide chamber 27 is illustrated at a distance from the switching gas damper 1 in FIG. 1, in order to assist understanding.

Figure 2:
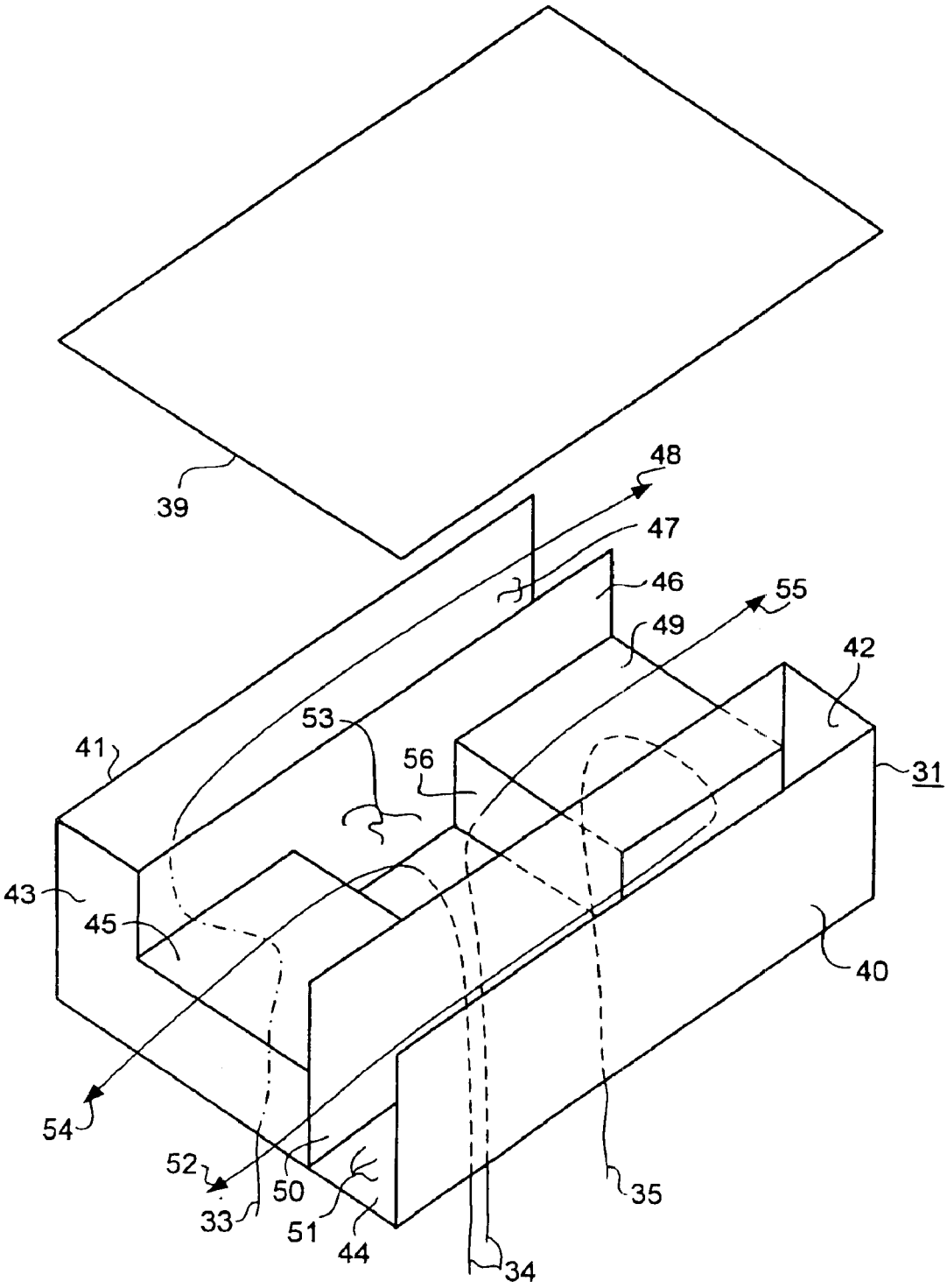
FIG. 2 shows a perspective schematic illustration of a second possible embodiment of the switching gas damper according to the invention, and the flow of the switching gases through it.

FIG. 2 shows, schematically, a second embodiment of a switching gas damper 31 according to the invention, and the flow paths of the switching gas flows 33, 34 and 35 through it. For illustration, the closed cover 39 of the switching gas damper 31, which still comprises a front wall 40, a rear wall 41, a right-hand side wall 42, a left-hand side wall 43 and a bottom 44 which is closed away from the inlet openings, has been illustrated in a raised position. A deflection element 45 forms an outlet channel 47, which is open on the right-hand side of the switching gas damper 31, together with a left-hand side wall 43, a channel wall 46 which extends from the bottom 44 of the switching gas damper 31 to its cover 39 and a side part which cannot be seen. A further deflection element 49 with a side part 56 forms an outlet channel 51, which is open on the left-hand side of the switching gas damper 31, together with the right-hand side wall 42 and a channel wall 50 which extends from the bottom 44 of the switching gas damper 31 to its cover 39. The two outlet channels 47 and 51 are closed at the top by the cover 39 of the switching gas damper 31 and at the bottom by its bottom 44. The arrangement of the deflection elements 45 and 49 results in free spaces, which form a third outlet channel 53, remaining between the deflection elements 45 and 49 and the channel walls 46 and 50, respectively, as well as the cover 39.

A switching gas flow 33, which emerges from the left-hand arcing chamber of the low-voltage power circuit breaker, which is not shown in FIG. 2 for simplicity, enters the switching gas damper 31 through the left-hand inlet opening, which is not illustrated for the sake of clarity and brevity. It is passed by the deflection element 45 into the outlet channel 47, which is formed by the cover 39, the left-hand side wall 43, the rear wall 41, the channel wall 46 and the bottom 44, from which it can emerge only on the right-hand side of the switching gas damper 31, as is indicated by the arrow 48.

A switching gas flow 35 which emerges from the right-hand arcing chamber of the low-voltage power circuit breaker enters the switching gas damper 31 through the right-hand inlet opening, which is likewise not illustrated for the sake of clarity and brevity. It is passed through the deflection element 49 into the outlet channel 51 formed by the cover 39, the right-hand side wall 42, the front wall 40, the channel wall 50 and the bottom 44, from which it can emerge only on the left-hand side of the switching gas damper 31, as indicated by the arrow 52. A switching gas flow 34 which emerges from the central arcing chamber of the low-voltage power circuit breaker enters the switching gas damper 31 through the central inlet opening, which is also not illustrated here for the sake of clarity and brevity. It passes directly into the outlet channel 53, which is formed by the cover 39, the channel wall 46, the channel wall 50, the deflection elements 45 and 49 and the bottom 44, from which it can emerge on both sides of the switching gas damper 31, as is indicated by the arrows 54 and 55.

Figure 3:
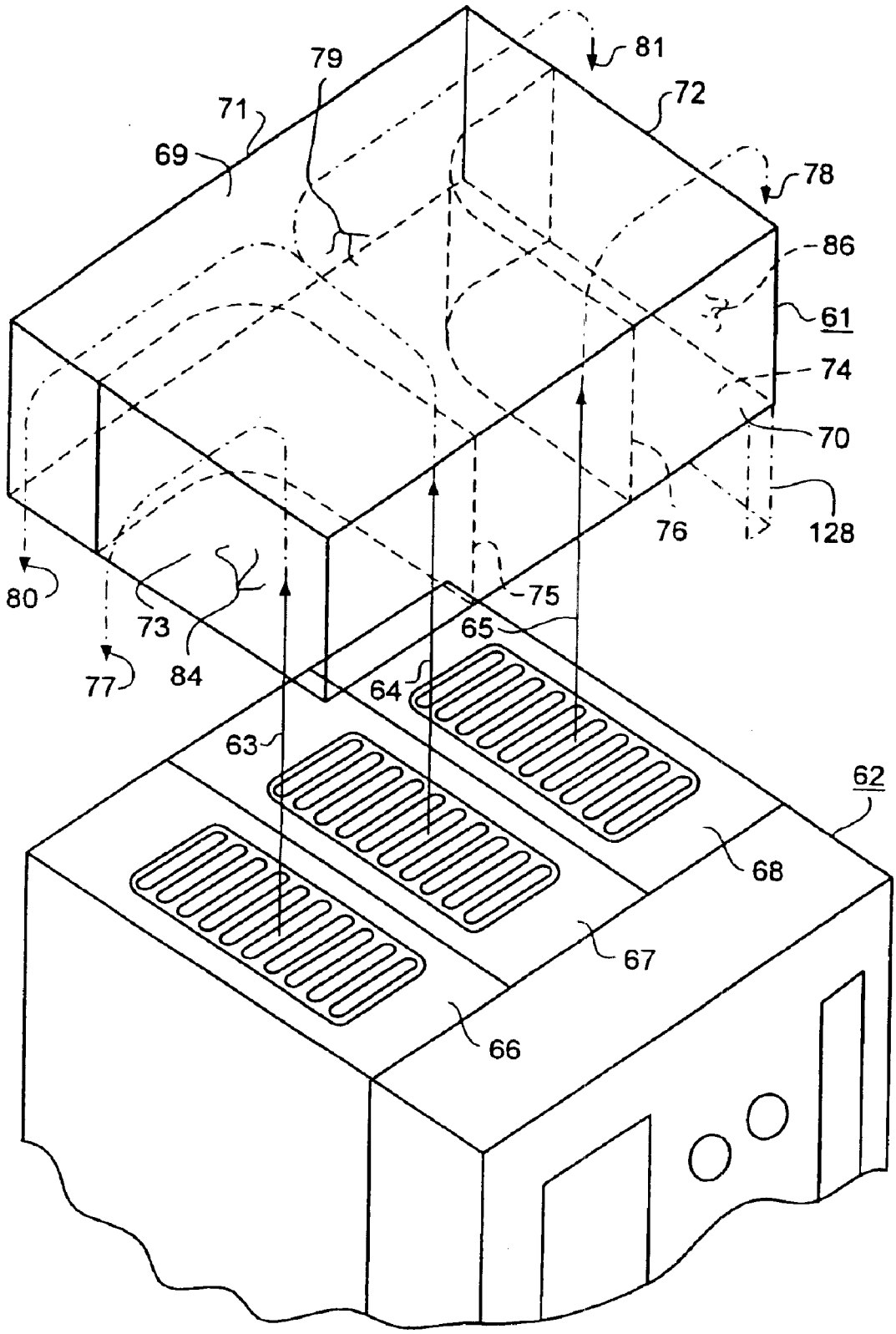
FIG. 3 shows a perspective schematic illustration of a third possible embodiment of the switching gas damper according to the invention in its physical position with respect to the low-voltage power circuit breaker, and the flow of the switching gases from the arcing chambers of the power circuit breaker through the switching gas damper.

FIG. 3 shows, schematically and as a third embodiment, a switching gas damper 61 in its physical position with respect to a low-voltage power circuit breaker 62, and the flow paths of switching gas flows 63, 64, 65 from arcing chambers 66, 67, 68 through the switching gas damper 61. In a corresponding way to the illustration in FIG. 1, this is illustrated at a physical distance from the low-voltage power circuit breaker 62, in order to illustrate the paths of the switching gas flows 63, 64, 65 from the individual arcing chambers 66, 67, 68.

The switching gas damper 61 includes a closed cover 69, a front wall 70, a rear wall 71, a closed right-hand side wall 72, a closed left-hand side wall 73, and a bottom 74 which is closed away from the inlet openings. This embodiment of the switching gas damper 61 is broader than the low-voltage power circuit breaker 62. This means that the switching gas flows 63, 64 and 65 can be carried away downward through the closed side walls 72, 73 at the sides of the low-voltage power circuit breaker 62, as is explained in conjunction with FIG. 4. For this purpose, the side walls 72 and 73 can be provided with guide plates pointing downward, or with extensions 128.

The switching gas flow 63 which emerges from the left-hand arcing chamber 66 of the low-voltage power circuit breaker 62 enters the switching gas damper 61 through the left-hand inlet opening, which is not illustrated for the sake of clarity and brevity. It is carried out of the switching gas damper 61 through the deflection element 75 and is deflected downward by the left-hand side wall 73, as indicated by the arrow 77. The switching gas flow 65 which emerges from the right-hand arcing chamber 68 of the low-voltage power circuit breaker 62 enters the switching gas damper 61 through the right-hand inlet opening, which is likewise not illustrated, for the sake of clarity and brevity. It is carried out of the switching gas damper 61 through the deflection element 76 and is likewise deflected downward by the right-hand side wall 72, as is indicated by the arrow 78.

The switching gas flow 64 which emerges from the central arcing chamber 67 of the low-voltage power circuit breaker 62 enters the switching gas damper 61 through the central inlet opening, which is also not illustrated here, for the sake of clarity and brevity. It is passed into the outlet channel 79, which is formed by the cover 69, the deflection elements 75 and 76 and the bottom 74, and from which it can emerge on both sides of the switching gas damper 61. This switching gas flow 64, which emerges in two flow elements at the sides, is also deflected downward by the closed side walls 72; 73, as is indicated by the arrows 80 and 81.

This embodiment of the switching gas damper 61 according to the invention means that the side walls can also be omitted, so that the switching gases can emerge at the sides without being influenced, provided the installation location of the low-voltage power circuit breaker 62 is suitable for this purpose.

Figure 4:
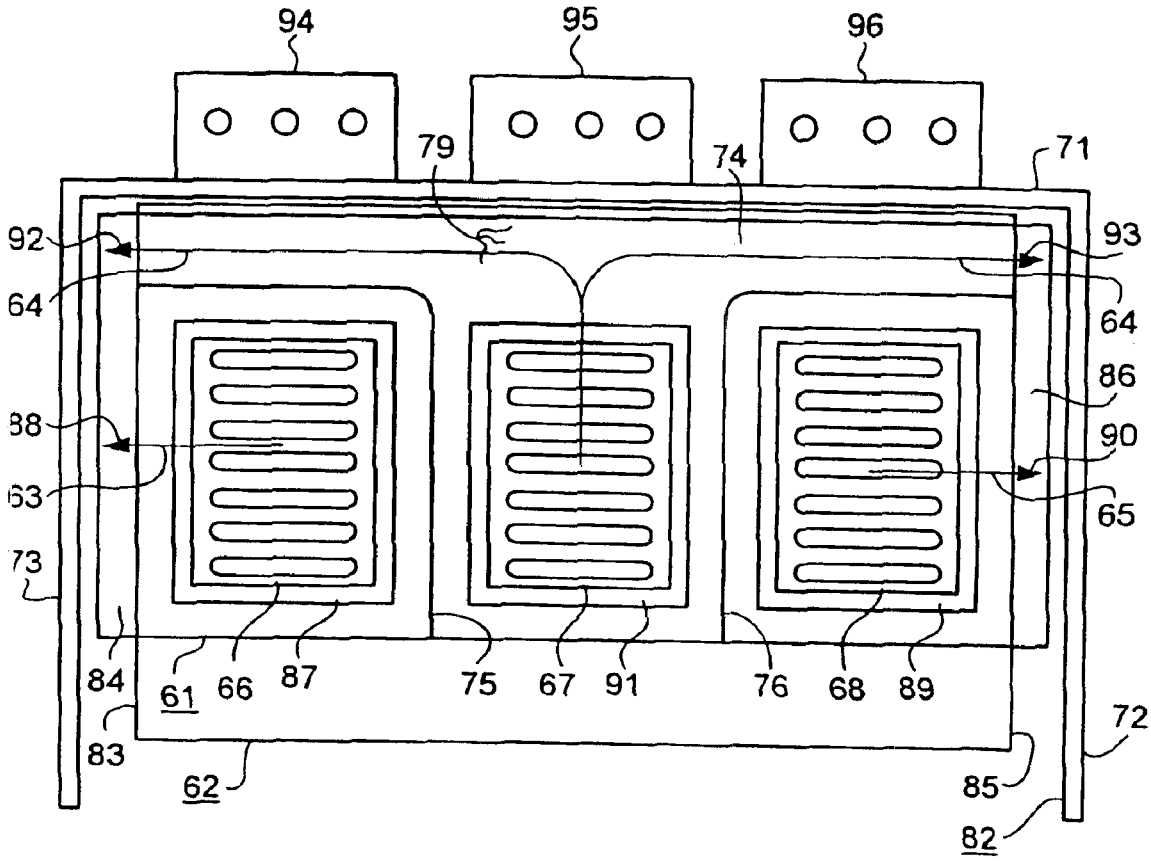
FIG. 4 shows a schematic plan view of the switching gas damper as shown in FIG. 3, but with the cover having been omitted.

FIG. 4 shows a schematic plan view of the embodiment of the switching gas damper 61 according to the invention and as illustrated in FIG. 3, with the cover having been omitted.

The switching gas damper 61 is broader than the low-voltage power circuit breaker 62, which is located in a withdrawable enclosure 82. An outlet channel 84 is thus formed between a left-hand side wall 83 of the low-voltage power circuit breaker 62 and the left-hand side wall 73 of the switching gas damper 61, and this outlet channel 84 is closed at the top by the cover 69 of the switching gas damper 61, and is open at the bottom.

There is likewise an outlet channel 86 between a right-hand side wall 85 of the low-voltage power circuit breaker 62 and the right-hand side wall 72 of the switching gas damper 61, and this outlet channel 86 is closed at the top by the cover 69 of the switching gas damper 61, and is open at the bottom. Three switching gas flows 63, 64 and 65, which are separated from one another, are bounded by the deflection elements 75 and 76, which extend from the bottom 74 to the cover 69 of the switching gas damper 61.

The switching gas flow 63 which emerges from the left-hand arcing chamber 66 of the low-voltage power circuit breaker 62 enters the switching gas damper 61 through the left-hand inlet opening 87. It is carried out of the switching gas damper 61 through the deflection element 75 and is deflected downward by the left-hand side wall 73 of the switching gas damper 61, as is indicated by an arrow 88. The switching gas flow 65 which emerges from the right-hand arcing chamber 68 of the low-voltage power circuit breaker 62 enters the switching gas damper 61 through the right-hand inlet opening 89. It is carried out of the switching gas damper 61 through the deflection element 76, and is likewise deflected downward by the right-hand side wall 72 of the switching gas damper 61, as is indicated by an arrow 90.

The switching gas flow 64 which emerges from the central arcing chamber 67 of the low-voltage power circuit breaker 62 enters the switching gas damper 61 through the central inlet opening 91. It is passed into the outlet channel 79, which is formed by the cover 69 (removed, FIG. 3), the deflection elements 75 and 76, the rear wall 71 and the bottom 74, and from which it can emerge on both sides of the switching gas damper 61. This switching gas flow 64, which emerges in the form of two flow elements at the sides, is also carried away downward by the closed side walls 72, 73 of the switching gas damper, as is indicated by the arrows 92 and 93. The connecting rails 94, 95 and 96 of the low-voltage power circuit breaker 62 are reliably protected against coming into contact with the switching gases by means of the rear wall 71 of the switching gas damper 61 and by the fact that the switching gases are carried away at the sides.

Figure 5:
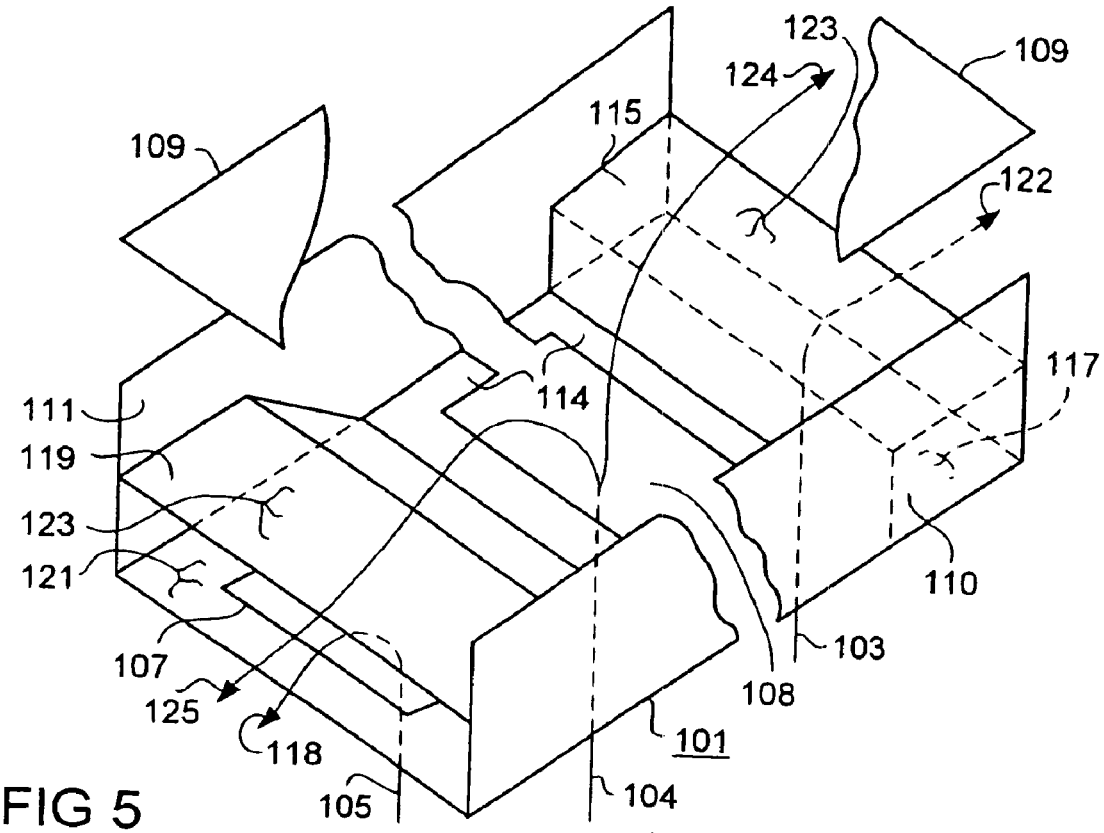
FIG. 5 shows a perspective schematic illustration of two versions of a fourth possible embodiment of the switching gas damper according to the invention, and the flow of the switching gases through it.

FIG. 5 shows a perspective, schematic illustration of two versions of a further embodiment of a switching gas damper according to the invention. The illustrated switching gas damper 101 has a front wall 110, a rear wall 111 and a bottom 114, which is closed away from the inlet openings 107 and 108 (a third inlet opening cannot be seen). A cover 109 is cut away, and is illustrated in a raised position.

In the embodiment version shown in the right-hand part of FIG. 5, deflection elements 15 are provided, which are in the form of parts with a right angle and, on the right-hand side of the switching gas damper 101, form open outlet channels 117 for the switching gas flow 103 from the outer arcing chambers of the low-voltage power circuit breaker, which is not illustrated. The flow direction is indicated by an arrow 122. The version shown in the left-hand part of FIG. 5 has deflection elements 119, which are likewise angled elements, but with an angle of more than 90°. The deflection elements 119 on the left-hand side of the switching gas damper 101 likewise form open outlet channels 121 for the switching gas flow 105 from the outer arcing chambers. The flow direction is indicated by an arrow 118 here.

In both the versions shown in FIG. 5, free spaces remain between the deflection elements 115 and 119, respectively, and the cover 109, and form an outlet channel 123 for carrying the switching gas flow 104 out of the central arcing chamber in opposite flow elements at the sides.

The switching gas flow 104 which emerges from the central arcing chamber of the low-voltage power circuit breaker enters the switching gas damper 101 through the central inlet opening 108. It is passed directly into the outlet channel 123, which is formed by the cover 109, the front wall 110, the rear wall 111 and the deflection elements 115 and 119, respectively, and from which it can emerge on both sides of the switching gas damper. The flow elements of the switching gases that result are indicated by arrows 124 and 125.

Figure 6:
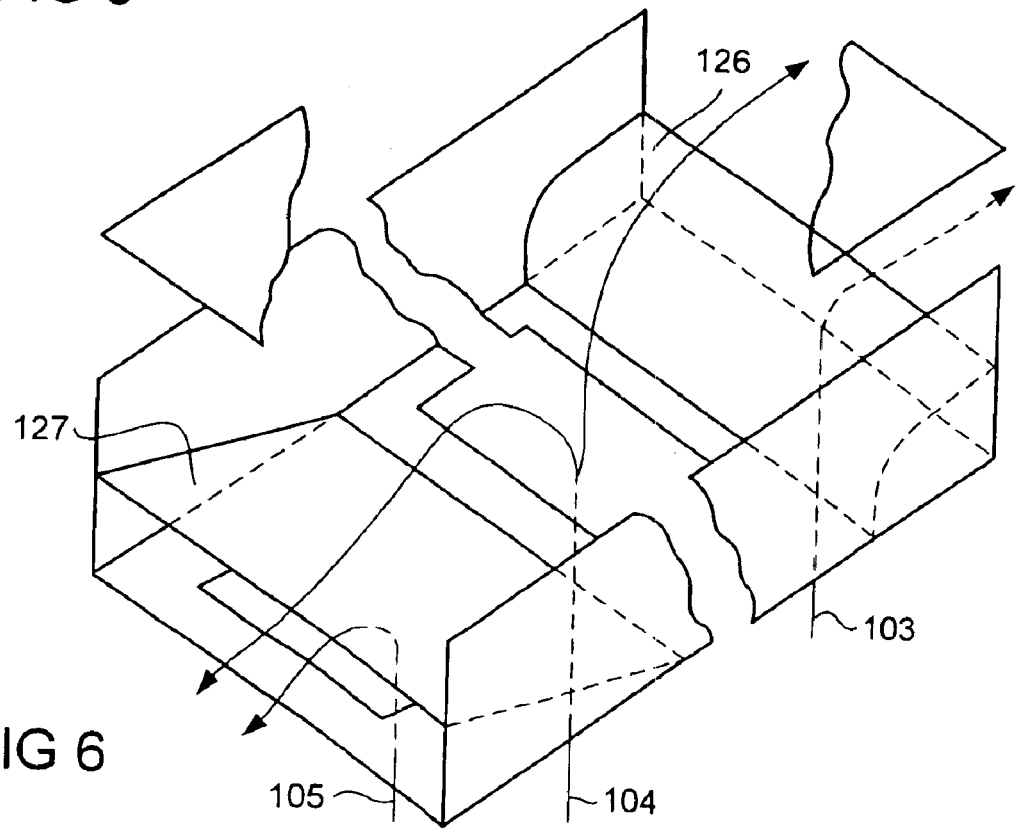
FIG. 6 shows a perspective schematic illustration of two further versions of the fourth possible embodiment of the switching gas damper according to the invention, and the flow of the switching gases through it.

FIG. 6 shows a perspective, schematic illustration of two further versions of a switching gas damper 101 according to the invention, and of the flow of the switching gas flows 103, 104, 105 through it. With the configuration and the method of operation otherwise being the same, for which reason all identical parts have not once again been provided with reference symbols, the deflection elements 126 and 127, respectively, used here are in the form of curved elements or, respectively, inclined straight elements. These versions will therefore not be explained further, once again.

The variable arrangement of the deflection elements and outlet channels explained above with reference to a number of exemplary embodiments of the invention means that it is possible to produce a number of mutually separate flow paths, with different desired damping and cooling characteristics, as a function of the amounts of gas that occur and the characteristics of the arcing chambers which are used.

The described switching gas dampers 1, 31, 61 and 101 may be produced integrally as a sheet-metal or plastic body, or may be assembled from a number of parts. A construction comprising a number of parts allows a number of versions to be manufactured using the same standard parts. For example, one such standard part may be a bottom, which has the inlet openings, and has an adjacent front or rear wall. A further standard part may be the cover. Alternatively, a cover with an attached front and rear wall may be provided as a standard part. These standard parts may be combined with assemblies composed of the same or a different material, which subdivide the interior into outlet channels, by means of channel walls and/or deflection elements.

For low-voltage power circuit breakers with very high rated currents and high switching ratings, a type having two or more switching poles per phase, and a corresponding number of arcing chambers, is known. The arcing chambers associated with one phase then form a unit, from the electrical point of view. In a corresponding way, one outlet channel can be provided jointly in each case for the arcing chambers of one switching pole, since the particular feature is separation of the switching gases between the individual phases. If, in contrast, it were to appear to be better, for example with regard to the use of standard parts, to provide an outlet channel for each individual arcing chamber, then this is likewise within the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching gas damper for low-voltage power circuit breakers, arranged as an attachment above the arcing chambers for at least one of additional damping, deionization and cooling of the switching gases, the attachment, comprising:

a cuboid enclosure with a front wall, a rear wall and a cover, wherein the cover is designed to be closed and a bottom including separate inlet openings is provided for receiving switching gas flows from each arcing chamber in the low-voltage power circuit breaker, and wherein each inlet opening includes an associated outlet channel, formed by at least one of channel walls and deflection elements, to dissipate the switching gas flows at sides extending at a right angle to the rear wall and the bottom.

2. The switching gas damper as claimed in claim 1, wherein, in a three-pole low-voltage power circuit breaker, a channel wall is arranged parallel to the front wall and a further channel wall is arranged parallel to the rear wall which, in conjunction with deflection elements, form a total of three outlet channels of which the outer outlet channels, bounded by the front wall and by the rear wall, are closed on opposite sides by a side wall, and wherein the central outlet channel, which is bounded by the channel walls, is open on both sides to permit the switching gas flows which emerge from the outer arcing chambers of the low-voltage power circuit breaker to be carried away separately on opposite sides, while the switching gas flow which emerges from the central arcing chamber is permitted to pass from the switching gas damper to free space on both sides through the central outlet channel.

3. The switching gas damper as claimed in claim 2, wherein the channel walls extend from the bottom to the cover of the switching gas damper, and wherein the side walls are arranged on the same side of the switching gas damper as the outer arcing chambers, such that the switching gas flows of the outer arcing chambers are passed, parallel to the front wall and to the rear wall of the switching gas damper, to the respectively opposite side of the low-voltage power circuit breaker, and the switching gas flow of the central arcing chamber is passed to the two opposite sides.

4. The switching gas damper as claimed in claim 2, wherein one deflection element is arranged such that it extends above the inlet openings which are associated with the outer arcing chambers in the bottom of the switching gas damper and between the channel walls, and wherein a side part is arranged on the mutually facing sides of the deflection elements in order to separate the switching gas flows of the outer poles and the switching gas flow of the central pole.

5. The switching gas damper as claimed in claim 4, wherein the first deflection element extends, starting from the bottom on the first channel wall, as far as the cover, and ending on the opposite channel wall, and wherein the further deflection element is arranged such that it rises in the opposite direction between the channel walls, with the side parts being shaped to match the rising arrangement of the deflection elements, so as to separate the switching gas flows of the outer arcing chambers and of the central arcing chamber.

6. The switching gas damper as claimed in claim 4, wherein the deflection elements are arranged parallel to the cover and to the bottom above the inlet openings for guiding the switching gas flows of the outer arcing chambers and extend from one channel wall to the other channel wall, and wherein side parts are arranged on the mutually facing sides of the deflection elements in order to separate the switching gas flows of the outer arcing chambers and the switching gas flow of the central arcing chamber.

7. The switching gas damper as claimed in claim 6, wherein the deflection elements are arranged at a position between the cover and the bottom of the switching gas damper.

8. The switching gas damper as claimed in claim 6, wherein the deflection elements are arranged at ⅔ of the height of the switching gas damper away from the bottom of the switching gas damper, and are arranged parallel to the bottom and to the cover.

9. The switching gas damper as claimed in claim 1, wherein the deflection elements are in the form of channel walls and are arranged such that the switching gas flows which emerge from the arcing chambers of the outer poles of the low-voltage power circuit breaker are carried away from the switching gas damper directly at the sides, and wherein the switching gas flow which emerges from the central arcing chamber is carried via at least one of and alongside the deflection elements to both opposite sides of the switching gas damper.

10. The switching gas damper as claimed in claim 9, wherein the deflection elements are arranged such that they extend from the bottom to the cover of the switching gas damper.

11. The switching gas damper as claimed in claim 10, wherein the deflection elements are arranged such that, originating from the front wall of the switching gas damper, they run between the inlet openings, which are located above the arcing chambers in the direction of the rear wall, are then angled, and wherein each runs behind the inlet openings for the switching gases from the outer arcing chambers as far as the side boundary of the switching gas damper in such a manner that an outlet channel is formed, which is coupled to the space above the central arcing chamber of the low-voltage power circuit breaker and which is open on both sides of the switching gas damper, for the switching gas flow of this central arcing chamber.

12. The switching gas damper as claimed in claim 11, wherein the angles of the deflection elements are rounded.

13. The switching gas damper as claimed in claim 9, wherein the deflection elements are arranged such that they extend between the front wall and the rear wall such that one outlet channel for an outer arcing chamber is bounded by the bottom and a deflection element and an outlet channel, which is open on both sides and is connected to the central inlet opening in the bottom, is formed for the central arcing chamber between the deflection elements and the cover.

14. The switching gas damper as claimed in claim 1, wherein a direction-changing enclosure with a guide chamber is attached to the side of the switching gas damper, on at least one side of the switching gas damper, in order to carry the switching gas flows which emerge from the switching gas damper at the side of the low-voltage power circuit breaker away downward.

15. The switching gas damper as claimed in claim 12, wherein the direction-changing enclosure is angled.

16. The switching gas damper as claimed in claim 1, wherein the cover of the switching gas damper is lengthened beyond its side boundary, and is provided with guide elements pointing downward.

17. The switching gas damper as claimed in claim 16, wherein the guide elements are formed by elongations, which extend downward at the sides along the low-voltage power circuit breaker, of the side walls of the switching gas damper.

18. The switching gas damper as claimed in claim 3, wherein one deflection element is arranged such that it extends above the inlet openings which are associated with the outer arcing chambers in the bottom of the switching gas damper and between the channel walls, and wherein a side part is arranged on the mutually facing sides of the deflection elements in order to separate the switching gas flows of the outer poles and the switching gas flow of the central pole.

19. The switching gas damper as claimed in claim 18, wherein the first deflection element extends, starting from the bottom on the first channel wall, as far as the cover, and ending on the opposite channel wall, and wherein the further deflection element is arranged such that it rises in the opposite direction between the channel walls, with the side parts being shaped to match the rising arrangement of the deflection elements, so as to separate the switching gas flows of the outer arcing chambers and of the central arcing chamber.

20. The switching gas damper as claimed in claim 18, wherein the deflection elements are arranged parallel to the cover and to the bottom above the inlet openings for guiding the switching gas flows of the outer arcing chambers and extend from one channel wall to the other channel wall, and wherein side parts are arranged on the mutually facing sides of the deflection elements in order to separate the switching gas flows of the outer arcing chambers and the switching gas flow of the central arcing chamber.

21. A switching gas damper comprising:

an enclosure with a front wall, a rear wall, a cover, and a bottom, which includes inlet openings for receiving switching gas flows from arcing chambers in a low-voltage power circuit breaker; wherein each inlet opening includes an outlet channel, formed by at least one of a plurality of channel walls and a plurality of deflection elements, and the cover is closed such that the switching gas flows are discharged laterally at sides perpendicular to the rear wall and perpendicular to the bottom.

* * * * *